US008763755B2

(12) United States Patent
Hagberg et al.

(10) Patent No.: US 8,763,755 B2
(45) Date of Patent: Jul. 1, 2014

(54) PORTABLE WORK PLATFORMS AND METHOD THEREFOR

(71) Applicant: San Diego Gas & Electric Company, San Diego, CA (US)

(72) Inventors: Ross Hagberg, San Diego, CA (US); Brent Clingman, Vista, CA (US); Jay Mathy, Santee, CA (US)

(73) Assignee: San Diego Gas & Electric Company, San Diego, CA (US)

( * ) Notice: Subject to any disclaimer, the term of this patent is extended or adjusted under 35 U.S.C. 154(b) by 0 days.

(21) Appl. No.: 13/623,377

(22) Filed: Sep. 20, 2012

(65) Prior Publication Data

US 2013/0075194 A1 Mar. 28, 2013

Related U.S. Application Data

(60) Provisional application No. 61/538,635, filed on Sep. 23, 2011.

(51) Int. Cl.
*E04G 3/00* (2006.01)

(52) U.S. Cl.
USPC ..... 182/46; 182/187; 348/218.4; 348/219.4; 108/152

(58) Field of Classification Search
USPC ..... 182/46, 187, 188; 108/152; 211/107; 248/218.4, 219.4, 219.1, 282.1
See application file for complete search history.

(56) References Cited

U.S. PATENT DOCUMENTS 1,515,831 A * 11/1924 Bush ..... 182/188
2,168,111 A 8/1939 Barnes
4,641,727 A * 2/1987 McKelvy ..... 182/46

(Continued)

FOREIGN PATENT DOCUMENTS

JP 07-102827 A 4/1995
JP 3043731 U 9/1997
JP 2007-211476 A 8/2007

OTHER PUBLICATIONS

Definition 1 of "truss" provided in the Action The American Heritage® Dictionary of the English Language, Fourth Edition copyright © 2000 by Houghton Mifflin Company. Updated in 2009. Published by Houghton Mifflin Company. All rights reserved.*

(Continued)

*Primary Examiner* — Alvin Chin Shue
*Assistant Examiner* — Daniel Cahn
(74) *Attorney, Agent, or Firm* — Klein O'Neill & Singh, LLP

(57) ABSTRACT

Work platforms are generally discussed herein for providing expanded work space for their users with specific discussions extended to portable work platforms that are mountable on vertical or horizontal poles and the like, such as utility poles, for expanding useful work space. The portable work platform has a deck attached to a base by a beam, which is made from a non-conducting material. A strap assembly having a webbing is connected to the base and configured for use with a ratchet mechanism to tension the webbing around a pole to mount to the platform. The beam enhances electrical isolation between the deck and the base.

10 Claims, 4 Drawing Sheets

(56) References Cited

U.S. PATENT DOCUMENTS

| | | | | | |
|---|---|---|---|---|---|
| 4,678,147 | A | * | 7/1987 | Barnes et al. | 248/74.1 |
| 5,078,232 | A | * | 1/1992 | Hancosky | 182/187 |
| 5,131,496 | A | * | 7/1992 | White | 182/187 |
| 5,172,881 | A | * | 12/1992 | Stein | 248/230.8 |
| 5,348,118 | A | * | 9/1994 | Franklin et al. | 182/187 |
| 5,435,412 | A | * | 7/1995 | Franklin et al. | 182/188 |
| 5,450,927 | A | * | 9/1995 | Harton et al. | 182/187 |
| 5,518,083 | A | * | 5/1996 | Blennert | 182/188 |
| 5,921,517 | A | * | 7/1999 | Meuth | 248/230.8 |
| 5,927,666 | A | * | 7/1999 | Barkan | 248/225.11 |
| 6,601,811 | B1 | * | 8/2003 | Van Lieshout | 248/282.1 |

OTHER PUBLICATIONS

Definition 2 of "truss" provided in the Action Random House Kernerman Webster's College Dictionary, © 2010 K Dictionaries Ltd. Copyright 2005, 1997, 1991 by Random House, Inc. All rights reserved.*

International Search Report completed Feb. 19, 2013 and mailed Feb. 20, 2013 from corresponding International Application No. PCT/US2012/056518 filed Sep. 21, 2012 (3 pages).

Written Opinion completed Feb. 19, 2013 and mailed Feb. 20, 2013 from corresponding International Application No. PCT/US2012/056518 filed Sep. 21, 2012 (6 pages).

* cited by examiner

PORTABLE WORK PLATFORMS AND METHOD THEREFOR

FIELD OF ART

Work platforms are generally discussed herein for providing expanded useful work space with specific discussions extended to portable work platforms that are mountable on vertical or horizontal poles and the like, such as utility poles, for expanding useful work space.

BACKGROUND

Workers that work on elevated projects, such as tree climbers, utility workers, cable workers, journeymen, etc., will often find themselves dangling by straps to a vertical pole when performing work. Typically, the worker is supported by two opposing pole steps that project from the pole with a safety strap wrapped around the pole and attached at both ends to the worker, such as to a safety belt worn about the waist.

Poles and pole steps come in several sizes and types. For example, there are wooden poles, composite poles, and metal poles, such as galvanized steel poles, and poles for specific applications, such as joint poles (for electric power, cable television, and telephone); power poles; telephone poles; cable poles; and railroad poles. Pole steps can include bent rods and plates and made from fiberglass or metal. Regardless of the poles or pole steps in question, a worker working on a pole is typically confined to two pole steps and secured in place by a safety strap. Due to the size of the pole steps, slippage is a concern and maneuverability is greatly limited.

SUMMARY

An aspect of the present device and assembly includes a portable work platform comprising a deck attached to a base by a beam, which is made from a non-conducting material. In exemplary embodiments, the base comprises two channels defined by two sets of flanges wherein a strap assembly comprising a webbing is disposed, at least in part, inside the two channels and wherein the beam defines an operating gap between the deck and the base.

A further feature of the portable work platform includes a round beam made from a fiberglass material to electrically isolate the base from the deck.

A still further feature of the portable work platform includes providing the webbing with two ends and wherein one of the ends comprises a loop having a rod extended therethrough.

A still further feature of the portable work platform is a webbing comprising a high temperature resistance material that has a high melting point than that of polyester.

A still yet further feature of the present portable work platform includes providing the beam from fiberglass with a wall thickness of at least ½-inch.

In a specific embodiment, the portable work platform is provided with a mounting frame comprising a receiving bore for receiving the beam.

To facilitate mounting, the portable work platform is provided with a base plate comprising an arcuate surface for closely fitting to a pole having an arcuate contour.

In still yet another embodiment, the work platform is provided with a deck rail that is configured as a barrier for preventing slippage.

Another aspect of the present device and assembly comprises a portable work platform comprising a deck attached to a base by a beam, which is made from a non-conducting material. Wherein the base comprises two channels defined by two sets of flanges and wherein a strap assembly comprising a Kevlar webbing is disposed, at least in part, inside the two channels.

A still further aspect of the present disclosure is a method for mounting a portable work platform onto a pole. The method comprising placing an arcuate surface on a base plate against an arcuate surface on a pole; the base plate being located on a base, which is attached to a beam that is connected to a deck. The method can further include the step of anchoring a first end of a webbing to the base and wrapping the webbing around the pole so that a second end of the webbing is anchored to the base. The method can further include tensioning the webbing by activating a ratchet mechanism and isolating the deck from the base from electrical arcing by providing an operating gap between the base and the deck and wherein the beam is made from a non-conducting material.

A still further feature of the present method is the provision for forming the beam from a fiberglass material.

A still further feature of the present method is the provision for forming the beam from a carbon fiber material.

A still yet further feature of the present method comprises the step of adjusting the deck for alignment by rotating the deck relative to the beam.

The method can further include the step of changing the arcuate surface to an arcuate surface having a different curvature.

Another aspect of the present method includes forming the deck from fiberglass for providing electrical isolation.

BRIEF DESCRIPTION OF THE DRAWINGS

These and other features and advantages of the present device, system, and method will become appreciated as the same becomes better understood with reference to the specification, claims and appended drawings wherein:

DETAILED DESCRIPTION

The detailed description set forth below in connection with the appended drawings is intended as a description of the presently preferred embodiments of portable work platforms provided in accordance with aspects of the present device, system, and method and is not intended to represent the only forms in which the present device, system, and method may be constructed or utilized. The description sets forth the features and the steps for constructing and using the embodiments of the present device, system, and method in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

Figure 1:
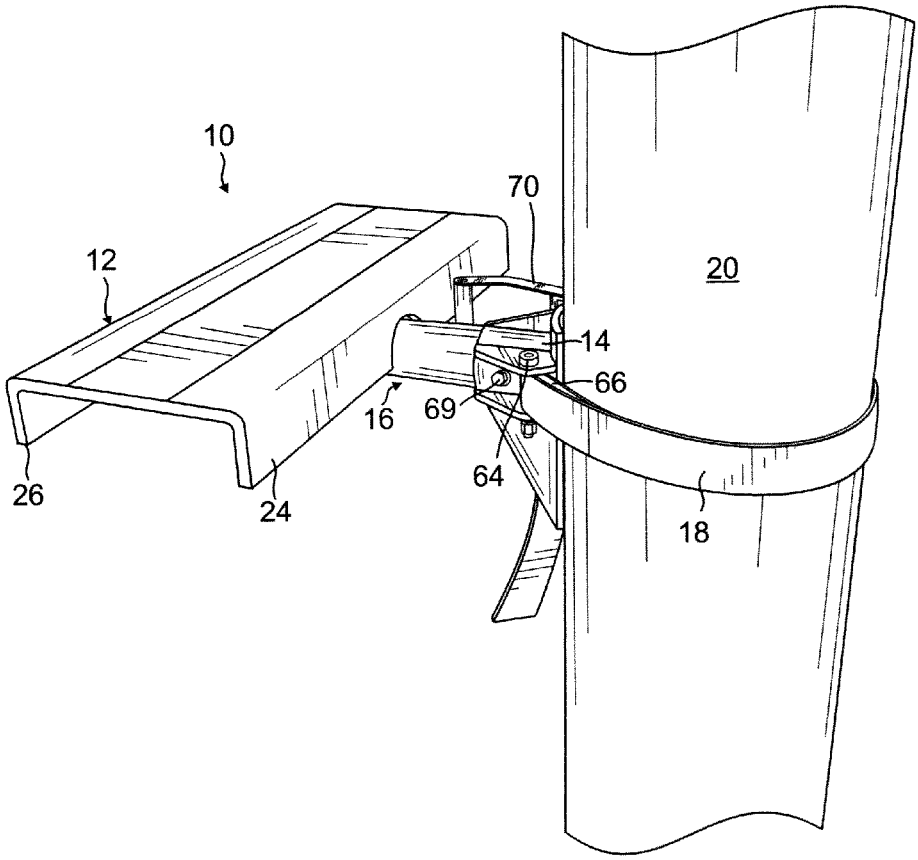
FIG. 1 is a perspective view of a work platform provided in accordance with aspects of the present device, system, and method mounted on a pole.

Refer now to FIG. 1, a schematic perspective view of a portable work platform provided in accordance with aspects of the present device, system, and method is shown, which is generally designated 10. In one exemplary embodiment, the platform 10 comprises deck 12, also referred to as a stand plate or top, attached to a pole bracket or base 14 via a beam or arm 16. As further discussed below, the base or pole bracket 14 functions as an anchor when used with a mounting strap assembly 18 to removably fix the platform 10 to a pole 20. In one example, the pole is a galvanized steel utility pole. In another embodiment, the pole is a composite pole or a wooden pole. The pole may be used for a specific function, such as a cable pole or a telephone pole, or as a joint pole, such as for electric power, cable television, and telephone.

Figure 2:
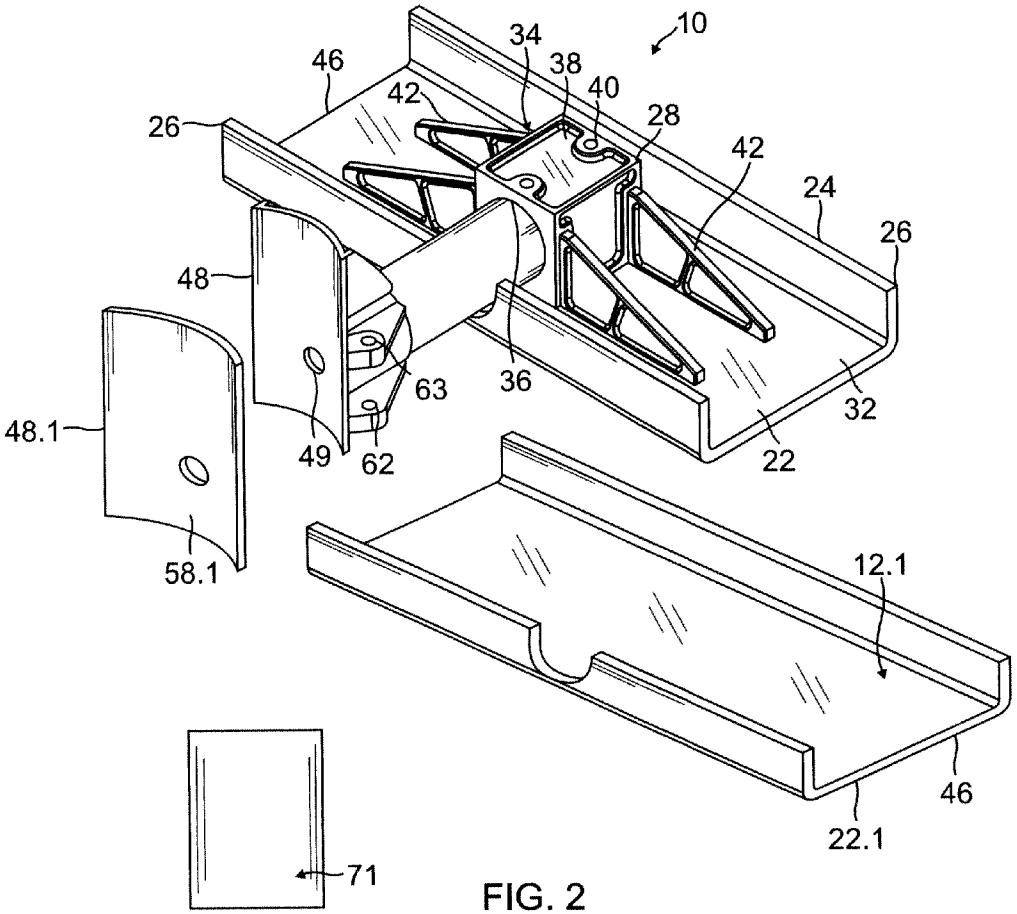
FIG. 2 is a perspective view of the work platform of FIG. 1 from a different angle showing the underside of the work platform and not mounted to any pole. Replacement or add-on base plates and decks are also shown.
Figure 3:
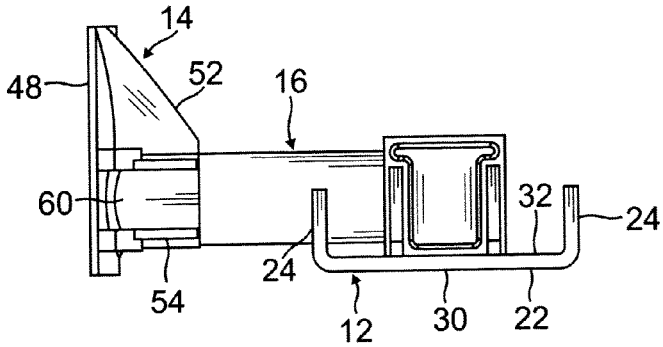
FIG. 3 is a side elevation view of the work platform of FIG. 1.

With reference now to FIGS. 2 and 3 in addition to FIG. 1, the deck 12 includes a generally planar working surface 22 defining a working area of about 1.5 $Ft^2$ to about 4 $Ft^2$. In some embodiments, the working area is less than 1.5 $Ft^2$ while in other embodiments the surface area is greater than 4 $Ft^2$. The deck 12 can be constructed from a metal material, such as from an aluminum material. In other embodiments, the deck 12 is made from a non-metallic material, such as from an engineered plastic, from fiberglass, from a composite, or combinations thereof For example, the deck may be made from polyetheretherketone (PEEK), polyetherketone (PEK), polyethylene terephthalate (PET), or similar engineered plastics. Carbon fiber is also a viable material option for the deck 12. The material and size, such as thickness, length and width, should be selected to provide sufficient support for an average worker with appropriate safety factors. Alternatively, the deck may be selected and sized to meet any industry, field, or engineering standards, such as ASTM standards. In some embodiments, such as shown in FIGS. 1-4, the deck 12 includes at least one side flange 24 (two side flanges are shown) to further reinforce the working surface 22. The working surface has an upper surface 30 and a lower surface 32, which may be referred to as first surface and second surface, respectively. The side flange 24 can extend the width of the working surface 22 and is selected with its own width of sufficient dimension to reinforce the working surface 22. The side flange 24 preferably includes corners 26 with radiuses that prevent chipping or sharp edges.

The working surface 22 may include bumps, channels and/or protrusions (not shown), generally referred to as surface features, on its upper surface 30 to increase friction or surface contacts. The surface features may be machined, formed, or molded onto the upper surface 30. Alternatively or in addition thereto, heavy duty adhesive backed sandpaper may be attached to the upper surface 30 to provide increased surface friction. The adhesive backed sandpaper may be attached in spaced apart strips or as a single large friction surface.

With reference again to FIGS. 2-4, a mounting frame 28 is provided on the lower surface 32 of the deck 12. In one exemplary embodiment, the mounting frame 28 includes a mounting block 34, which has a receiving bore 36 for receiving the beam 16. The receiving bore 36 may be round, square, oval or other configuration and preferably matches the outer contour or configuration of the beam 16. A top block surface 38 is provided and includes one or more threaded bosses 40 for receiving one or more set screws (not shown) to secure against the outer surface of the beam 16. In other embodiments, the beam 16 is secured to the mounting block 34 through other means, such as by welding or bonding. In one example, the beam 16 is secured to the deck 12 but is removable or rotatable therefrom to enable replacement, maintenance, and/or angular alignment. Alternatively, the beam 16 may be rotatable relative to the base 14 for alignment purposes by adjusting the base screw 69 (FIG. 1). The mounting block 34 may be separately formed and subsequently attached to the lower surface 32 of the working surface 22, such as by welding, gluing, mechanical engagement (for example, detents, fasteners), and co-molding or insert-molding, depending on the material selection of the deck 12.

Figure 4:
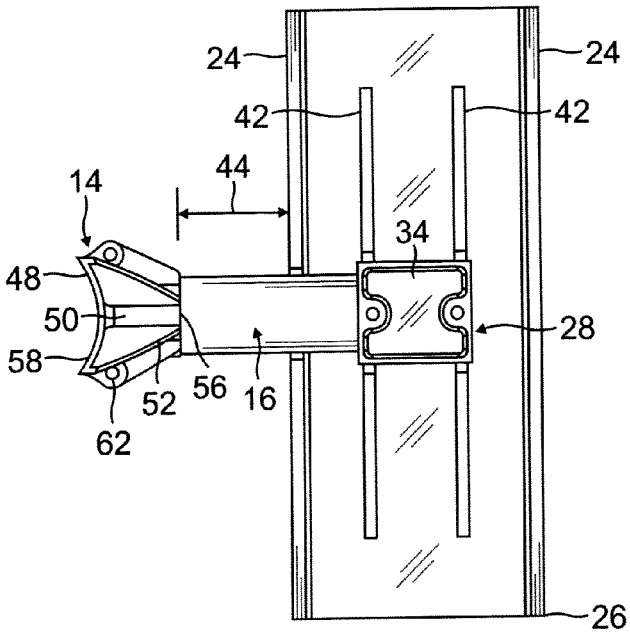
FIG. 4 is a bottom plan view of the work platform of FIG. 1.

In one example, two or more trusses 42 are incorporated on the lower surface 32 of the deck 12. The trusses 42 reinforce the deck from contorting or bending and preferably embody the shape of a triangle with a right angle. While the trusses 42 can attach only to the deck 12, such as to the lower surface 32 and to one or both side flanges 24, the trusses are shown attached to both the deck 12 and the mounting block 34 through conventional means, such as through mechanical engagement, welding, or bonding. In one example, the deck 12 is made from an aluminum material, the mounting block 34 is machined from an aluminum billet, the trusses 42 are cast or machined, and the components are welded together. In a specific example, four trusses are incorporated and are attached to four corners of the mounting block. The trusses can extend to the ends or edges 46 of the working surface 22 or not as far, as shown in FIGS. 2 and 4. The height of the mounting block 34 and the trusses 42 may be greater than the height of the side flanges 24 so that the mounting frame 28 extends higher than the side flanges 24, as shown in FIG. 3. In another embodiment, the side flanges 24 have a greater height than the mounting frame 28.

In one example, the arm or beam 16 is made from fiberglass with a 3-inch diameter and a wall thickness of about ½-inch with other diameters and thicknesses contemplated. In another example, the beam 16 is made from carbon fiber. Preferably, the beam 16 is made from a non-conductive material to electrically isolate the deck 12 from the base 14, as further discussed below. Less preferably, the beam 16 is made from a metallic material and has an outer non-conductive cover or layer. The length of the beam 16, from end-to-end, may be selected as desired and/or to comply with industry or engineering standards. The overall length of the beam 16 controls, at least in part, the operating gap 44 (FIG. 4) of the portable platform 10, which is the distance or space between one of the side flanges 24 closes to the base 14 and the base. In one example, the operating gap 44 is greater than three inches, such as six inches or more, for example, sixteen inches. In another example, the operating gap 44 is selected to ensure appropriate electrical isolation between the pole bracket 14 and the deck 12.

The base 14 is preferably made from the same material as the deck 12 but optionally can differ. In one example, the base 14 comprises a base plate 48, a receiving socket 50 having an opening 56 for receiving the beam 16, a first set of flanges or fins 52, and a second set of flanges or fins 54. The various base components may be unitarily formed, such as by casting. Alternatively, the components are separately formed and subsequently assembled to form the base, such as by welding, mechanical engagement, or both. As shown, the base plate 48 has an arcuate surface 58 for form fitting against the curvature of a pole 20 and an optional opening 49 for inspection, such as to verify that the beam is properly placed into the receiving socket 50. The arcuate surface 58 may approximate the curvature of the pole or an average curvature of several different poles. Still alternatively, the arcuate surface 58 may approximate the average curvature taken at a certain height along the pole, such as for a pole that tapers inwardly from bottom to top. In yet another embodiment, different bases 14 with different shaped arcuate surfaces 58 are interchangeable so that a particular deck 12 may be used with different bases 14 depending on the pole to be attached therewith. In still yet another embodiment, different base plates 48.1 with different arcuate surfaces 58.1 are interchangeable with the base plate 48 located on the base 14. For example, the base plate 48 shown in FIG. 2 may be removed from the base 14 and a different base plate 48.1 having a different arcuate surface 58.1 fitted to the base 14 to replace the removed base plate. Similarly, the deck 12 from a portable work platform 10 may be interchangeable with a different deck 12.1 to provide different work surface area. In one example, the deck 12 may be removable and the replacement deck 12.1 mounted in its place. In another example, the replacement deck 12.1 may be mounted on top of the deck 12 and secured in place, such as by straps, fasteners, or other prior art mechanical engagement mechanisms.

With continued reference to FIG. 2 in addition to FIG. 1, a pliable insert 71 is provided for added compliance when the portable work platform 10 is mounted on a pole 20. In one example, the pliable insert 71 is a rubber sheet or gasket. In another example, the pliable insert is multi-layer woven material and with an inner rubber material, such as that use in a fire hose. The pliable insert 71 is configured to be placed between the arcuate surface 58 of the base plate 48 and the pole 20 to provide added gripping or friction. The use of the pliable insert is preferred when the pole is a metal or galvanized pole and helps to reduce scraping or scarring the pole. In another example, a plastic or rubber coating is applied directly onto or over the base plate 48.

With reference again to FIGS. 3 and 4, the first set of flanges 52 comprises at least two individual flanges that are generally triangular in shape. The two flanges 52 are attached directly to the base plate 48 and to the receiving socket 50, which may be an aluminum pipe or machined from a solid billet. As shown in FIG. 4, the two flanges 52 from the first set of flanges are angled inwardly towards a longitudinal centerline of the beam 16.

In one example, the second set of flanges 54 comprises four individual flanges. The four flanges 54 are mounted generally horizontally and have surfaces that are co-planar or parallel with the upper surface 30 of the deck 12. The four flanges 54 are mounted in sets of two with each set located on either side of the longitudinal axis of the beam 14 and each including a boss 62. In the example shown, each set of two flanges 54 are mounted in a spaced apart relationship to define a mounting channel 60 therebetween. As mounted, the bosses 62 from two adjacent flanges 54 align to form receiving slots 63 for an anchor pin or bolt, as further discussed below. Accordingly, the described base 14 comprises four flanges 54 mounted in two sets of two to define two mounting channels 60. The base is also understood to include four aligned bosses 62 that form two receiving slots 63 for receiving two sets of anchor pins or bolts.

Refer again to FIGS. 1-3, two anchor bolts 64 are configured to each slide into a slot 63 defined by two aligned bosses 62. The anchor bolts 64 are configured for use as anchor points for a mounting strap assembly 18, which has a flat and elongated strap 67, also known as a webbing, having a loop 66 at one end for receiving one of the anchor bolts 64, and a free end 68 for wrapping around the other anchor bolt 64 and then wound into a ratcheting mechanism 70 to take up the slack and to tension the webbing 67 around the pole 20. As understood, the portable work platform 10 is to be placed along a desired elevation on a pole 20 before the webbing is tensioned around the pole.

Webbing materials usable with the disclosed portable work platform 10 include those made from Nylon and Kevlar or composites thereof. TABLE 1 shows exemplary webbing specifications that are usable with the present device, system, and method.

TABLE 1

| | Webbing #1 | Webbing #2 |
|---|---|---|
| Material | 100% Nylon | 83% Kevlar/17% Polyester |
| Picks (per inch) | 26 min | 24 min |
| Weave | Tubular twill | Double plain |
| Width (mm) | 48.2-63.18 | 44.5 |
| Thickness (mm) | 1.778-2.032 | 2.1 |
| Tensile strength Min (lbs) | 7,500 min | 9,000 min |
| Weight, oz. per yard | 2.4-2.6 | 2.01 |
| Melting Point(° C.) | 260 | 500/260 |

The webbing material is preferably selected from a material with a high melting point. The high melting point enables the disclosed device, system, and method to withstand short bursts of arc flashing that can produce short but relatively high temperatures. In one example, the webbing material is made from 100% nylon. In another example, the webbing material is made from 100% Kevlar. In another example, the webbing material is a composite, such as from 70% to 90% Kevlar with the balance from polyester or nylon. In a specific example, the webbing material is made from 83% Kevlar and 17% polyester. The disclosed webbing materials are believed to have superior wear resistance from tightening and loosening around poles and superior temperature resistance from arc flashing that can produce relatively high temperatures. As set forth, the webbing comprises a high temperature resistance material that is higher than that of polyester.

With reference again to FIG. 1, as clearly shown, the deck 12 is spaced apart from the pole 20 and the base 14 by an operating gap 44 (FIG. 4) provided by the beam 16. As the beam is preferably non-conducting, a worker standing on the deck 12 is isolated from any electrical current provided by the gap. In other embodiments, the deck 12 is also made from a non-conducting material, such as from fiberglass or carbon fiber, and adds to the overall electrical isolation capability of the platform from potential electrical arcing, such as when used in connection with a utility pole. Thus, an aspect of the present device and assembly is a portable work platform 10 comprising a deck 12 attached to a beam 16 made from a non-conducting material, which is attached to a base 14 comprising a base plate 48. In one example, the base plate has an arcuate surface having a contour for mating contact with a round pole. In another example, the beam is sized with a length to provide an operating gap between the deck and the base that is sufficient to isolate the deck from electrical arcing.

A further feature of the present device and assembly is a mounting strap assembly comprising a webbing comprising a first end having a loop and a second end and wherein a rod is placed through the loop of the webbing and through a slot defined by two aligned openings on the base. The webbing can be understood to be made from a non-conducting material. In one example, the webbing material is made from a high temperature resistance material. In specific examples, the webbing is made from woven nylon or from Kevlar, with or without woven polyester.

A further feature is a method for manufacturing the described portable work platform and for mounting the portable work platform onto a pole using a mounting strap assembly. In one example, the mounting strap assembly comprises a combination Kevlar and polyester webbing and a ratcheting mechanism for tensioning the webbing around a pole. To provide added flexibility, the present method further includes a provision for using a pliable insert between the arcuate surface of the base plate and the pole, such as when mounting the portable work platform on a metal pole to increase gripping.

In a further aspect of the present device and assembly, the base plate 48 of the portable work platform is an add-on base plate 48.1 having an arcuate surface 58.1 with a different contour than the arcuate surface 58 of the original base plate 48. The add-on base plate 48.1 may be used to replace an existing base plate 48 located on a base 14, such as first removing the existing base plate and mounting the replacement base plate 48.1, or for mounting on top of or onto the existing base plate. The different arcuate surface 58.1 of the add-on base plate 48.1 allows the portable work platform 10 to be used and attached to a pole 20 having a different circumference or diameter by providing a different arcuate surface that can better match. In other words, provisions are provided in the disclosed device and assembly to better approximate the arcuate surface of the base plate with the diameter of the pole.

In a further feature of the present device and assembly, an add-on deck 12.1 is provided with a different working surface area 22.1 to either increase or decrease the working surface area of the existing deck 12 of a given portable work platform 10. The add-on deck 12.1 may be used to replace an existing deck 12 of a portable work platform, such as first removing the existing deck and mounting the replacement deck 12.1, or for mounting on top of or onto the existing deck 12.

Figure 5:
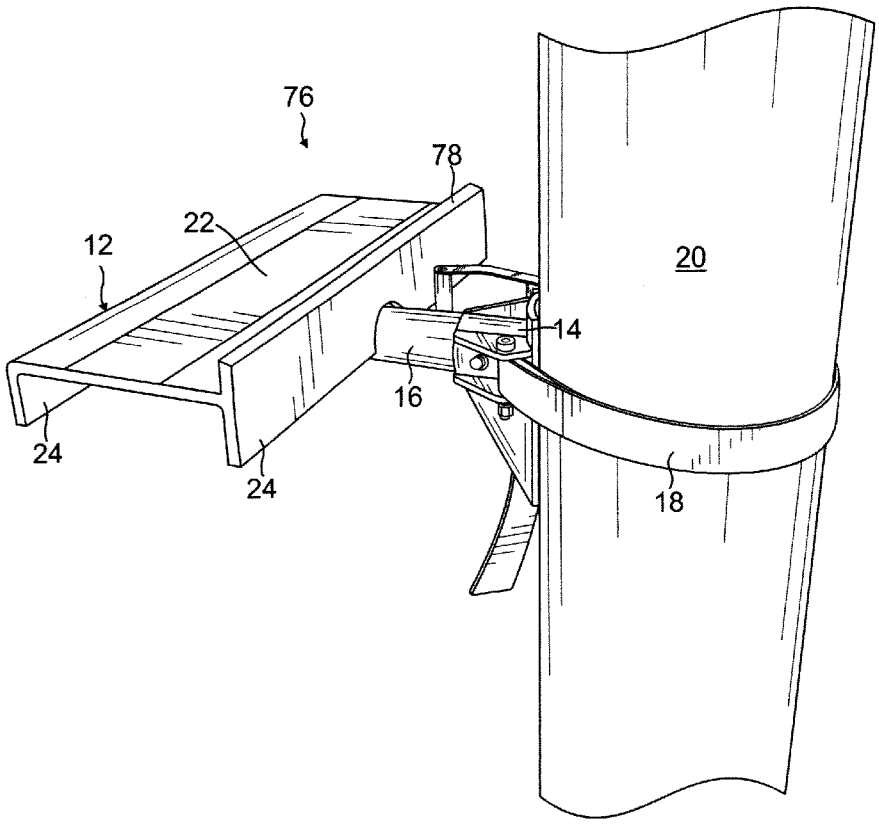
FIG. 5 is a perspective view of an alternative work platform provided in accordance with aspects of the present device, system, and method mounted on a pole.

With reference now to FIG. 5, a perspective view of an alternative work platform is shown, which is generally designated 76. The work platform 76 shares many features with the work platform 10 of FIG. 1, such as having a similar deck 12, beam 16, base 14, and mounting strap assembly 18. In the present example, the deck 12 further incorporates a deck rail or backstop 78, which extends upwardly or radially from the planar working surface 22. The deck rail 78 may generally be located at end edge of the working surface 22 and aligns with one of the side flanges 24. In another embodiment, the deck rail 78 is placed inwardly of the end edge along a section of the working surface 22. In yet another embodiment, the deck rail 78 is placed outwardly beyond the end edge, such as with an extension or L-type bracket. The deck rail 78 may have a width that is the same as the deck, less than the width of the deck, or greater than the width of the deck.

The deck rail 78 may be unitarily formed with the deck 12, such as by casting or molding. In another embodiment, the deck rail 78 is separately formed and subsequently secured to the deck 12 using mechanical means, such as using fasteners, detents, and the like. The deck rail 78 can extend outwardly or radially of the planar working surface 22 about one inch or more, such as three inches or higher. The deck rail 78 is configured as a barrier to prevent slippage when a worker is standing on the deck and leaning.

Although limited embodiments of work platform assemblies and their components have been specifically described and illustrated herein, many modifications and variations will be apparent to those skilled in the art. For example, the various platform components may be made from different materials than described, painted or highlighted with colors, include hooks and pockets for storage, and be mounted on a horizontal pole, etc. Furthermore, it is understood and contemplated that features specifically discussed for one work platform embodiment may be adopted for inclusion with another work platform embodiment, provided the functions are compatible. Accordingly, it is to be understood that the work platform assemblies and their components constructed according to principles of the disclosed device, system, and method may be embodied other than as specifically described herein. The disclosure is also defined in the following claims.

What is claimed is:

1. A portable work platform with an electrical current isolation feature and capable of supporting a worker comprising:

a deck attached to a base by a beam, said beam being made from a non-conducting material to provide electrical isolation between the deck and the base; said base comprising an arcuate surface for fitting against a curvature of a round vertical pole;

a mounting frame comprising a mounting block having an opening for receiving the beam;

at least two trusses in contact with the mounting block and in contact with an underside surface of the deck;

wherein the base comprises two channels defined by two sets of flanges and aligned in a single horizontal plane;

wherein a strap assembly comprising a webbing comprising a para-aramid synthetic fiber is disposed, at least in part, inside the two channels for supporting the deck on a vertical pole; and wherein the deck is spaced from the base by an operating gap, which is sized to electrically isolate the base from the deck.

2. The portable work platform of claim 1, wherein the beam is made from a metallic material and has an outer non-conductive cover or layer.

3. The portable work platform of claim 1, wherein the deck comprises a generally planar working surface and two side flanges extending therefrom.

4. The portable work platform of claim 1, wherein the opening matches an outer contour of the beam.

5. The portable work platform of claim 1, wherein the at least two trusses are triangular in shape.

6. The portable work platform of claim 1, wherein the beam is round and made from a fiberglass material.

7. The portable work platform of claim 6, wherein the beam has a wall thickness that is at least ½-inch.

8. The portable work platform of claim 1, wherein the webbing has two ends and wherein one of the two ends comprises a loop having a rod disposed therein.

9. The portable work platform of claim 1, further comprising a bolt passing through openings in at least one of the two sets of flanges and through the strap assembly.

10. The portable work platform of claim 1, wherein the deck has a deck rail comprising a planar surface that extends above and below the deck.

* * * * *

UNITED STATES PATENT AND TRADEMARK OFFICE

CERTIFICATE OF CORRECTION

PATENT NO. : 8,763,755 B2
APPLICATION NO. : 13/623377
DATED : July 1, 2014
INVENTOR(S) : Hagberg et al.

It is certified that error appears in the above-identified patent and that said Letters Patent is hereby corrected as shown below:

On the Title Page, Item (74), column 2, Attorney, Agent, or Firm, line 1, delete "Klein" and insert -- Klein, --, therefor.

In the Specification

In column 3, line 28, delete "thereof" and insert -- thereof. --, therefor.

Signed and Sealed this
Twenty-first Day of October, 2014

Michelle K. Lee

Michelle K. Lee
*Deputy Director of the United States Patent and Trademark Office*